US009648954B2

(12) United States Patent
Pirkl

(10) Patent No.: US 9,648,954 B2
(45) Date of Patent: May 16, 2017

(54) SLIDING SHELF CONTAINMENT SYSTEM AND METHOD

(71) Applicant: Gerald W. Pirkl, Henderson, NV (US)

(72) Inventor: Gerald W. Pirkl, Henderson, NV (US)

( * ) Notice: Subject to any disclaimer, the term of this patent is extended or adjusted under 35 U.S.C. 154(b) by 0 days.

(21) Appl. No.: 15/047,398

(22) Filed: Feb. 18, 2016

(65) Prior Publication Data

US 2016/0174711 A1 Jun. 23, 2016

Related U.S. Application Data

(62) Division of application No. 14/537,900, filed on Nov. 10, 2014, now Pat. No. 9,277,819.

(Continued)

(51) Int. Cl.

| | |
|---|---|
| ***A47F 5/00*** | (2006.01) |
| ***A47F 5/08*** | (2006.01) |
| ***A47B 96/02*** | (2006.01) |
| ***A47F 3/06*** | (2006.01) |
| ***A47B 45/00*** | (2006.01) |
| ***A47B 57/00*** | (2006.01) |
| ***A47F 5/01*** | (2006.01) |
| ***A47F 5/10*** | (2006.01) |

(Continued)

(52) U.S. Cl.

CPC ..... *A47B 96/025* (2013.01); *A47B 45/00* (2013.01); *A47B 57/00* (2013.01); *A47B 57/58* (2013.01); *A47F 3/06* (2013.01); *A47F 5/005* (2013.01); *A47F 5/0043* (2013.01); *A47F 5/0056* (2013.01); *A47F 5/01* (2013.01); *A47F 5/08* (2013.01); *A47F 5/10* (2013.01); *A47F 9/005* (2013.01)

(58) Field of Classification Search

CPC ..... A47B 2088/205; A47B 2088/207; A47B 2088/0033; A47B 88/0044; A47B 88/0051; A47B 88/0085; A47B 2088/0088; A47B 2088/0092; A47B 96/025; A47B 45/00; A47B 57/00; A47B 57/58; A47B 57/585; A47B 57/586; A47B 47/00; A47B 47/021; A47B 47/022; A47B 55/02; A47B 88/20; A47B 96/00; A47B 2088/202; A47B 88/0014; A47B 88/0018; A47B 96/16; A47B 2088/0007; A47F 3/06; A47F 5/005; A47F 5/0043; A47F 5/0056; A47F 5/01; A47F 5/08; A47F 5/10; A47F 9/005; A47F 3/14; A47F 5/0081; A47F 5/13; A47F 5/14; A47F 3/147; A47F 5/0018; A47F 5/0031; A47F 5/0068; A47F 5/0025; A47F 7/148; A47J 47/16

USPC .... 211/134, 175, 184, 43, 90.01–90.04, 193, 211/75, 106, 106.01, 87.01, 86.01, 181.1, 211/150, 126.15, 119.003, 45, 46, 88.01, 211/88.02; 312/205, 348.1–348.4; 248/200

See application file for complete search history.

(56) References Cited

U.S. PATENT DOCUMENTS 1,136,331 A * 4/1915 Harding ..... A47F 5/01 211/106

1,741,928 A * 12/1929 Gafney ..... A47F 5/08 211/106

(Continued)

*Primary Examiner* — Jennifer E Novosad

(74) *Attorney, Agent, or Firm* — Jonathan M. Rixen; Lemaire Patent Law Firm, P.L.L.C.

(57) ABSTRACT

Mechanisms and methods to install upper restrictive barriers onto existing pull-out shelves to prevent or decrease the likelihood of the shelf contents from falling over the back or sides of the shelf.

20 Claims, 8 Drawing Sheets

Related U.S. Application Data

(60) Provisional application No. 61/965,331, filed on Jan. 29, 2014, provisional application No. 61/908,188, filed on Nov. 25, 2013.

(51) Int. Cl.
*A47B 57/58* (2006.01)
*A47F 9/00* (2006.01)

(56) References Cited

U.S. PATENT DOCUMENTS 1,770,836 A * 7/1930 Boote ..... B42F 15/0035 312/348.3
1,936,517 A * 11/1933 Maine ..... F25D 23/126 211/106
2,144,534 A * 1/1939 Hedquist ..... A47B 45/00 211/88.01
2,226,763 A * 12/1940 Geib ..... A63H 33/06 211/194
3,999,663 A * 12/1976 Walter ..... B42F 15/0094 211/175
4,036,369 A * 7/1977 Eisenberg ..... A47B 45/00 108/102
4,219,247 A * 8/1980 Litchfield ..... A47B 88/00 211/46
4,733,925 A * 3/1988 Duran ..... A47B 45/00 312/248
4,765,490 A * 8/1988 Hanson ..... B42F 15/0094 211/175
5,037,163 A * 8/1991 Hatcher ..... A47B 21/0314 108/143
5,230,554 A * 7/1993 Camilleri ..... A47B 88/04 312/334.31
5,255,798 A * 10/1993 Aaldenberg ..... A47B 45/00 211/46
5,472,082 A * 12/1995 Thiele ..... A45C 7/0031 190/105
5,494,175 A * 2/1996 Higdon ..... B42F 15/0094 211/46
5,921,410 A * 7/1999 Emery ..... A47B 43/00 108/42
6,109,462 A * 8/2000 Emalfarb ..... A47F 5/01 211/119
6,216,894 B1 * 4/2001 Hendricks ..... A47B 63/00 211/194
6,364,136 B1 * 4/2002 Weshler ..... A47B 96/025 108/102
6,550,874 B2 * 4/2003 Walla ..... A47B 96/06 312/184
7,942,486 B2 * 5/2011 Petri ..... F24C 15/16 312/333
8,430,253 B1 * 4/2013 Jackson ..... A47B 97/00 211/106
8,608,262 B1 * 12/2013 Daros ..... A47B 88/0014 312/205
9,277,819 B1 * 3/2016 Pirkl ..... A47B 96/025
2004/0245254 A1 * 12/2004 Rosenberg ..... A47B 88/20 220/507
2007/0095768 A1 * 5/2007 Huo ..... A47B 45/00 211/113
2007/0138116 A1 * 6/2007 Metcalf ..... A47B 96/025 211/90.01
2007/0159040 A1 * 7/2007 Fernandez ..... B25H 3/023 312/348.3
2008/0074021 A1 * 3/2008 Croft ..... A47B 96/025 312/334.1
2008/0185387 A1 * 8/2008 Wu ..... A47B 88/20 220/510
2008/0258593 A1 * 10/2008 Berger ..... A47B 88/20 312/348.3
2014/0001134 A1 * 1/2014 Merey ..... A47B 88/20 211/86.01

* cited by examiner

SLIDING SHELF CONTAINMENT SYSTEM AND METHOD

CROSS-REFERENCE TO RELATED APPLICATIONS

This application is a divisional of U.S. patent application Ser. No. 14/537,900 filed on Nov. 10, 2014 by Gerald William Pirkl, titled "SLIDING SHELF CONTAINMENT SYSTEM" (which issued as U.S. Pat. No. 9,277,819 on Mar. 8, 2016), which is incorporated herein by reference in its entirety, and which claims priority benefit of U.S. Provisional Patent Application No. 61/908,188 filed Nov. 25, 2013 by Gerald W. Pirkl, titled "SLIDING SHELF CONTAINMENT SYSTEM," and of U.S. Provisional Patent Application No. 61/965,331 filed Jan. 29, 2014 by Gerald William Pirkl, titled "SLIDING SHELF CONTAINMENT SYSTEM."

FIELD OF THE INVENTION

The present invention relates to shelves, and in particular to systems and methods for containing objects placed on a sliding shelf.

BACKGROUND OF THE INVENTION

There are no specifications that relate to dimensional qualities of slide out shelves. Typical sliding shelves are custom built for their needed application. When we think of slide out shelves, kitchen food storage, pots and pans, cleaning products, laundry supplies, garage storage, and other storage applications come to mind. Custom built slide out shelves for these applications are usually constructed from a wood or laminate, or combination thereof. Typical shelves sides are random heights, but the majority of products that I have researched, have what the industry refers to as the height of the width of a credit card. This translates to two and a quarter inches (5.7 cm)—plus or minus. There are custom built installations that have taller sides, and depending on the total height between the floor of the sliding shelf, in question, and the bottom of the shelf above it, may not need this invention. My research shows that the vast majority of owners of typical slide out shelves have a problem with objects falling off the shelves when in operation.

A Patent Search has been conducted by an independent patent attorney, studying items that relate to 'Sliding Shelf and Barrier.' The closest U.S. Pat. No. 6,039,422. Other sliding shelf patents reviewed are: U.S. Pat. Nos. 7,942,486; 7,806,277; 6,364,136; 5,230,554; 5,037,163; and 4,901,972. His written opinion claims that he did not find any patented products that fit the description of my invention.

Two Provisional Patents 61/908,188 and 61/965,331, have been submitted for two different versions of this invention. I have included both of them in this one Non-Provisional Submittal.

BRIEF SUMMARY OF THE INVENTION

The advantages of this invention are to eliminate or greatly reduce materials falling over the edge or sides of slide out shelves.

DETAILED DESCRIPTION OF THE INVENTION

FIGS. 1A, 1B, 1C and 1D relate to the first embodiment corresponding to Provisional Application 61/908,188.

1. The sliding shelf, front, back, sides, and bottom, are existing elements of a conventional sliding shelf unit.
2. Sliding shelves are built in random lengths and widths, and this invention will accommodate units from 12.0 inches to 22.5 inches (30.5 cm to 57.2 cm) in length and 12.0 inches to 30.0 inches (30.5 cm to 76.2 cm) in width. Standard two rail system can accommodate an 8-inch (20.3-cm) sliding-shelf space. A three rail system can accommodate up to an 11-inch (27.9-cm) space.
3. Element 115 (also referred to herein as a containment member)—telescoping rail of metal or rigid material, to accommodate shelf varying widths and lengths.
4. Drawings for this embodiment are: FIG. 1A, FIG. 1B, FIG. 1C, and FIG. 1D.

Figure 1A:
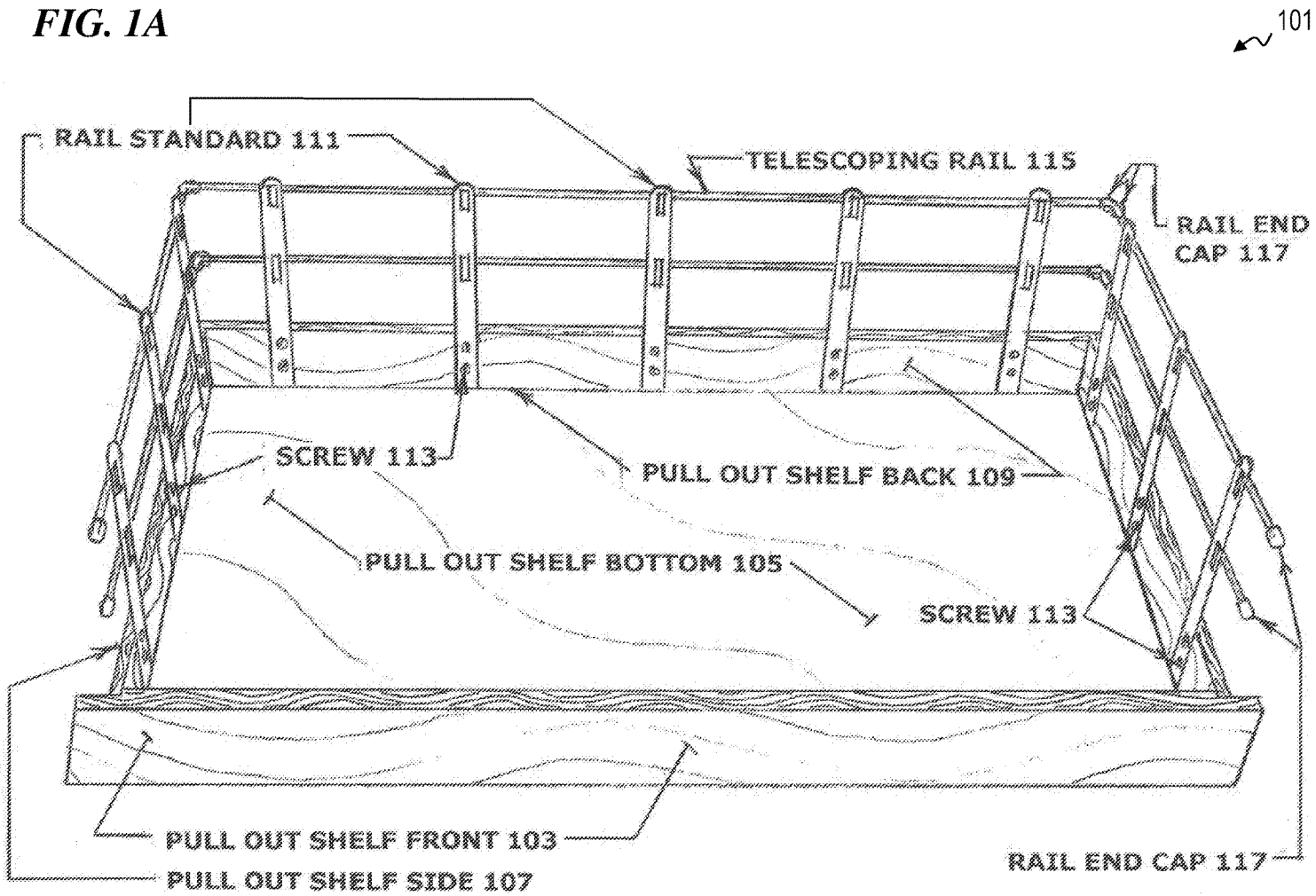
FIG. 1A is a top oblique view of a sliding shelf, shown with a rail containment system 101 according to one embodiment of the present invention.

FIG. 1A is a top oblique view of a sliding shelf and a rail containment system 101.

1. Existing sliding shelf, elements 103 front, 105 bottom, 107 side, and 109 back.
2. Element 111 (also referred to herein as a containment-member support)—rail standard—is attached to the shelf sides and back, every four to six inches, with screws, and holds the rails in place.
3. Element 113—self tapping, #8, ½ inch lath screws, attach rail standards 111 to sides and back of sliding shelf.
4. Element 115—telescoping rail of metal or rigid material, to accommodate shelf varying widths and lengths.
5. Element 117—rail end cap of rubberized or plastic material, to close off the ends of the rails, and eliminate sharp edges.

Figure 1B:
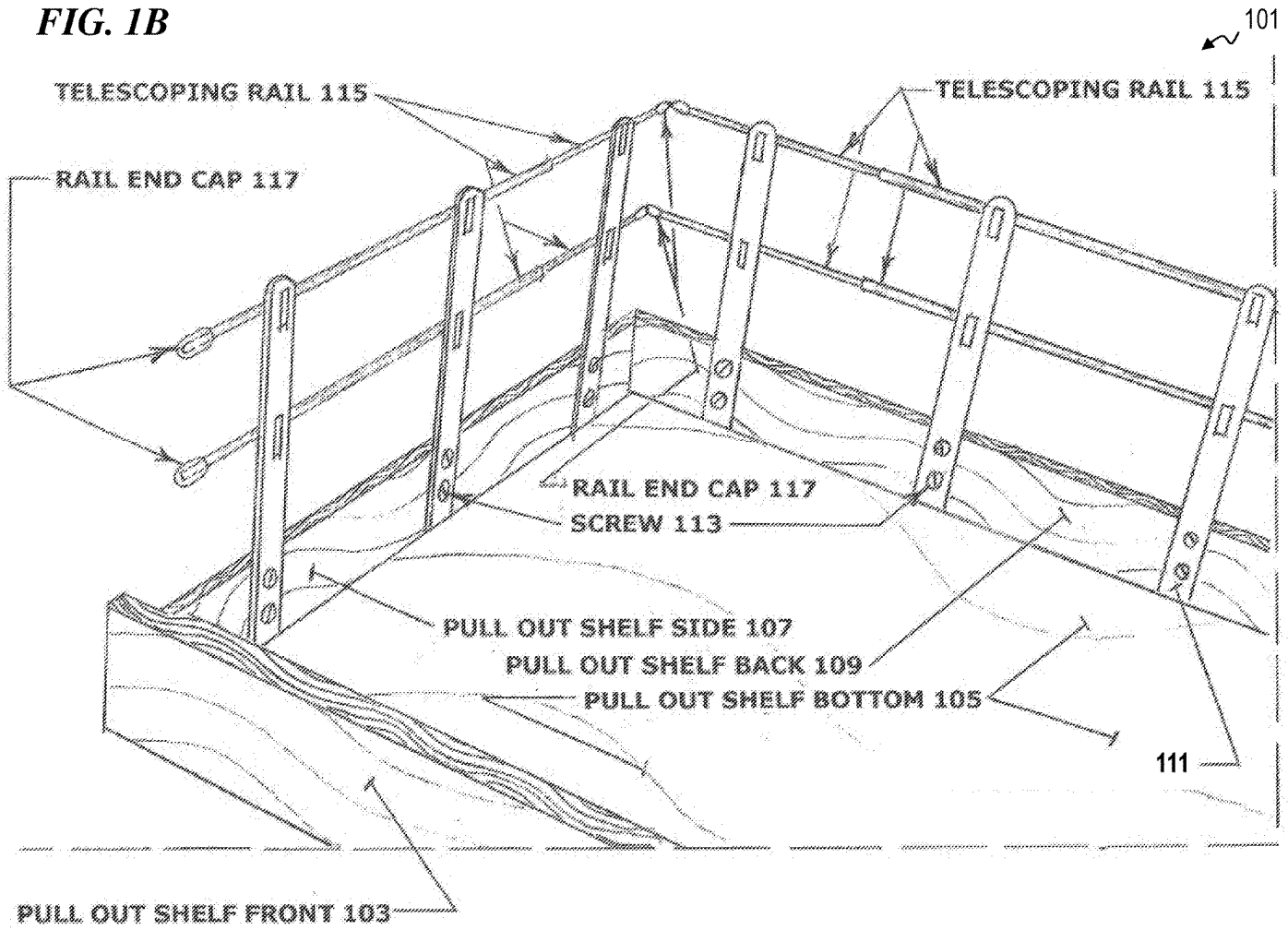
FIG. 1B is an enlargement oblique view of the top left rear corner of the containment shelf of rail containment system 101.

FIG. 1B is an enlargement oblique view of the top left rear corner of the containment shelf and rail containment system 101.

1. Existing sliding shelf, elements 103 front, 105 bottom, 107 side, and 109 back.
2. Element 111—rail standard—is attached to the shelf sides and back, every four to six inches (10 to 15 cm), with screws, and holds the rails in place.
3. Element 113—self tapping, #8, ½ inch lath screws, attach rail standards 111 to sides and back of sliding shelf.

4. Element 115—telescoping rail of metal or rigid material, to accommodate shelf varying widths and lengths.
5. Element 117—rail end cap of rubberized or plastic material, to close off the ends of the rails, and eliminate sharp edges.

Figure 1D:
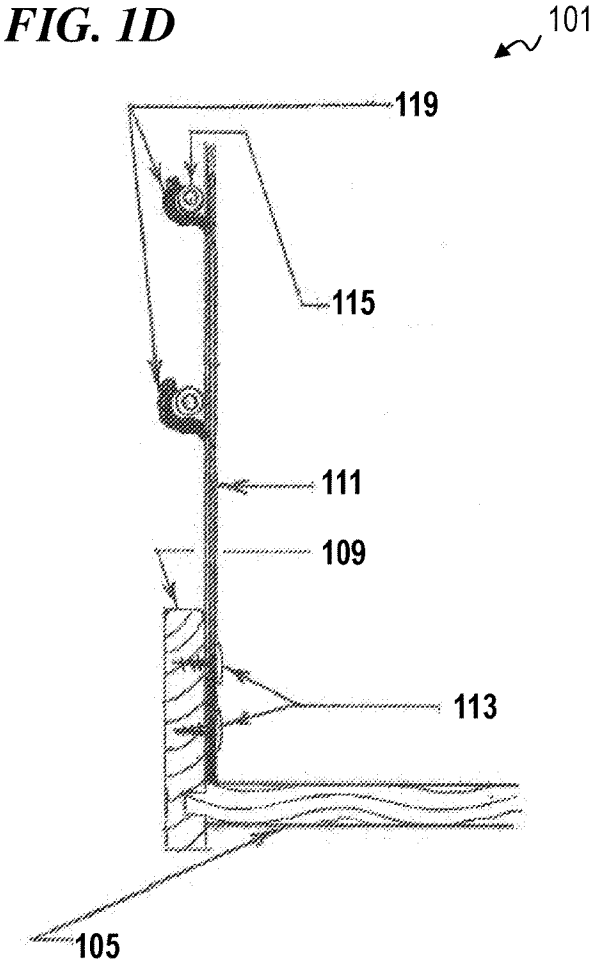
FIG. 1D is a side enlargement view of the rail standard of FIG. 1C.
Figure 1C:
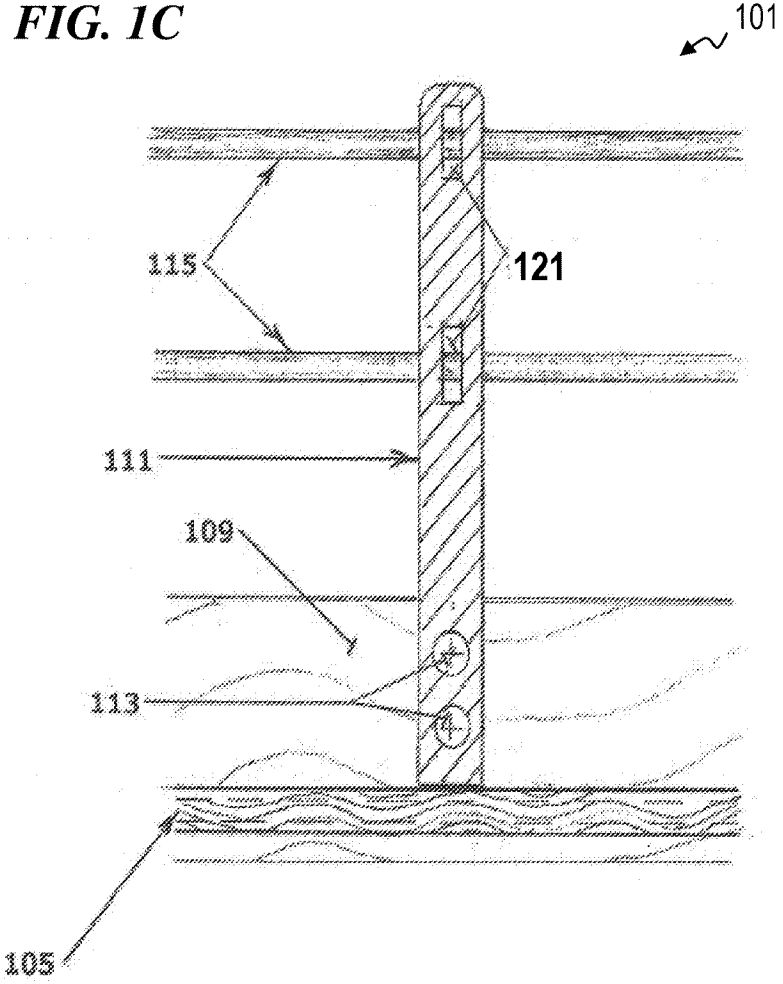
FIG. 1C is a front enlargement view of a rail standard of rail-containment system 101.

FIG. 1C is a front enlargement view of a rail standard in rail containment system 101.

FIG. 1D is a side enlargement view of the rail standard of FIG. 1C.

1. Existing sliding shelf, elements 105 bottom, 107 side, and 109 back.
2. Element 111—rail standard is a metal or rigid material, approximately ⅛ inch in thickness, by ⅞ inch in width, by 8.0 inches in height (taller standards may hold up to three rails; for example, a first containment member, a second containment member, and a third containment member).
3. Element 113—self tapping, #8, ½ inch lath screws, attach rail standards 111 (for example, a first containment-member support, a second containment-member support, and a third containment-member support) to sides and back of sliding shelf.
4. Element 115—telescoping rail of metal or rigid material, to accommodate shelf varying widths and lengths. The outside diameter of these rails may be up to ½ inch in diameter.
5. Element 119—rail cradle is a metal stamping, or molded protrusion from the rail standard 111 material, made to hold the telescoping rails. The rails can have a thin plasticized material wrapped around the rails at the location of the cradles to provide flexibility when snapping the rail into the cradle. A thicker plasticized material will be wrapped around the inner telescoping rail, to accommodate a snug fitting into the standard size cradle.

FIG. 2A, FIG. 2B, FIG. 2C, and FIG. 2D relate to the second embodiment corresponding to Provisional Application 61/965,331.

In FIG. 2A, FIG. 2B, FIG. 2C, and FIG. 2D:

1. The sliding shelf, front, back, sides, and bottom, are existing elements of a conventional sliding shelf unit.
2. Sliding shelves are built in random lengths and widths, and this invention will accommodate units from 12.0 inches to 22.5 inches in length and 12.0 inches to 30.0 inches in width. Standard system can accommodate an 8 inch high sliding shelf space. An 11.0 inch containment panel can accommodate up to a 12 inch high space.
3. Element 135—containment panel can have elongated screw hole channels to allow panel sliding movement, to accommodate shelf varying widths and lengths.
4. Drawings for this embodiment are: FIG. 2A, FIG. 2B, FIG. 2C, and FIG. 2D.

Figure 2A:
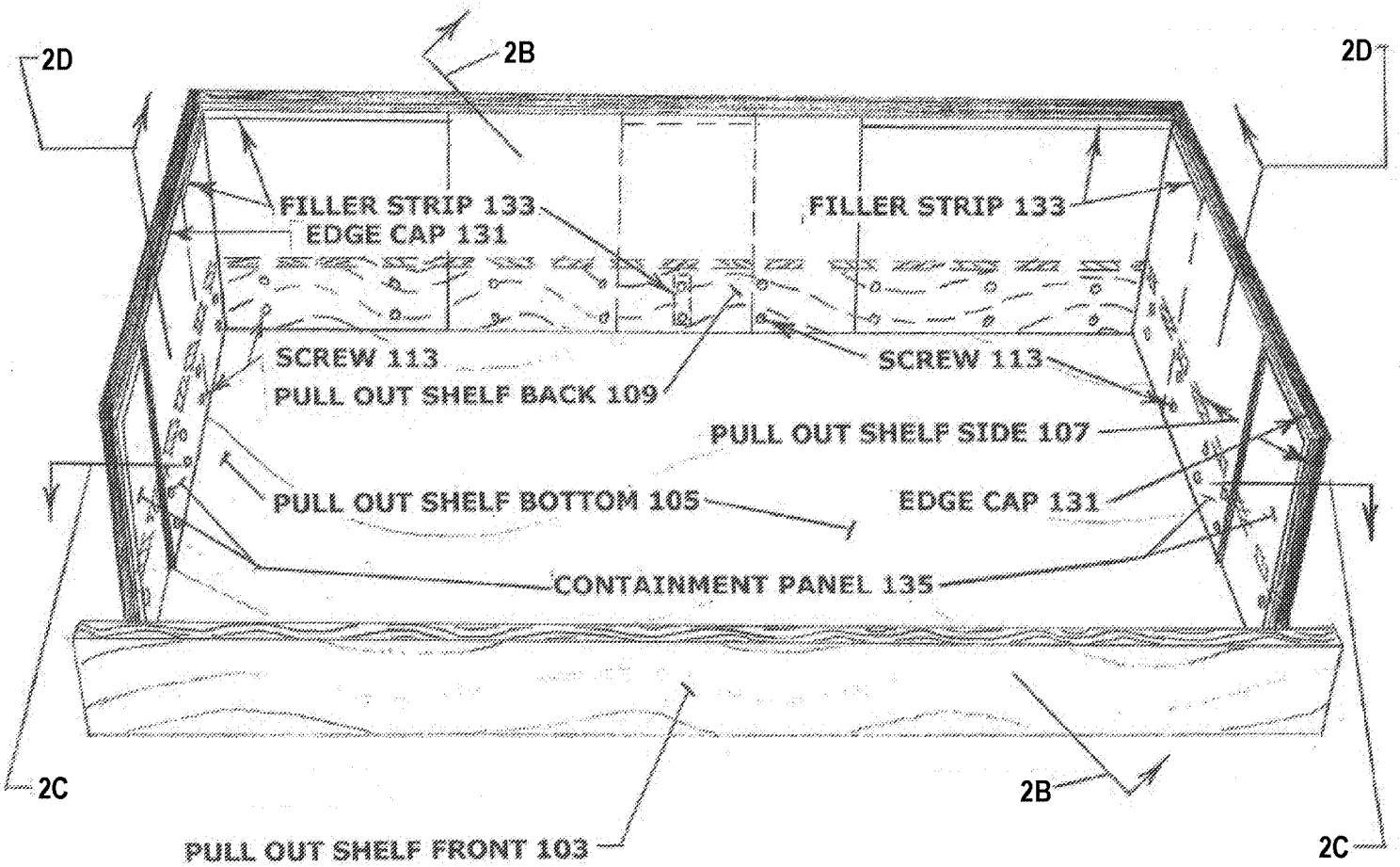
FIG. 2A is a top oblique view of a sliding shelf, with a rigid-panel containment system 201 according to one embodiment of the present invention.

FIG. 2A is a top oblique view of a sliding shelf and a rigid panel containment system 201.

1. Existing sliding shelf, elements 103 front, 105 bottom, 107 side, and 109 back.
2. Element 135—is a rigid material, approximately ⅛ inch in thickness that may be opaque or transparent. This material is attached to the shelf sides and back, every four to six inches (10 to 15 cm), with screws 113, and holds the material in place (for example, in some embodiments, a first containment member includes a first flat piece 135 and a second flat piece 135 on a side 107 of the sliding shelf, and a second containment member includes a first flat piece 135, a second flat piece 135, and a third flat piece 135 on the back 109 of the sliding shelf). Elongated screw hole channels allow for panel sliding movement, to accommodate shelf varying widths and lengths.
3. Element 113—self tapping, #8, ½ inch lath screws, attach containment panels 135 to sides and back of sliding shelf.
4. Element 131—edge cap is a rigid plasticized material forming a U channel that has an approximate inside dimension of ¼ inch in width by ½ inch legs. This cap clips together the containment panels 135 and filler strips 133 to reinforce the containment panel 135 edges, while at the same time, eliminating sharp edges. Material can accommodate cutting to various lengths with a razor knife or similar.
5. Element 133—filler strip is an approximate ¾ inch strip of containment panel 135 material, used under the edge cap 131, at places where overlapping panels do not occur (for example, in some embodiments, the present invention includes a first cap filler strip 133 and a second cap filler strip 133). This strip provides a second thickness to accommodate the snap-on edge cap 131. The filler strip 133 has an etched groove every ½ inch of its length, to accommodate selecting the approximate length by utilizing snap breaking joints. The filler strip 133 is held in place with a mastic type material of rubberized or plastic material. Filler strip 133 material is also used in 2.0 inch lengths (for example, in some embodiments, the present invention includes a first panel filler strip 133 and a second panel filler strip 133) to provide double wall thickness at screw locations, where only a single inside (closest to the center of the shelf) containment panel 135 exists.

Figure 2B:
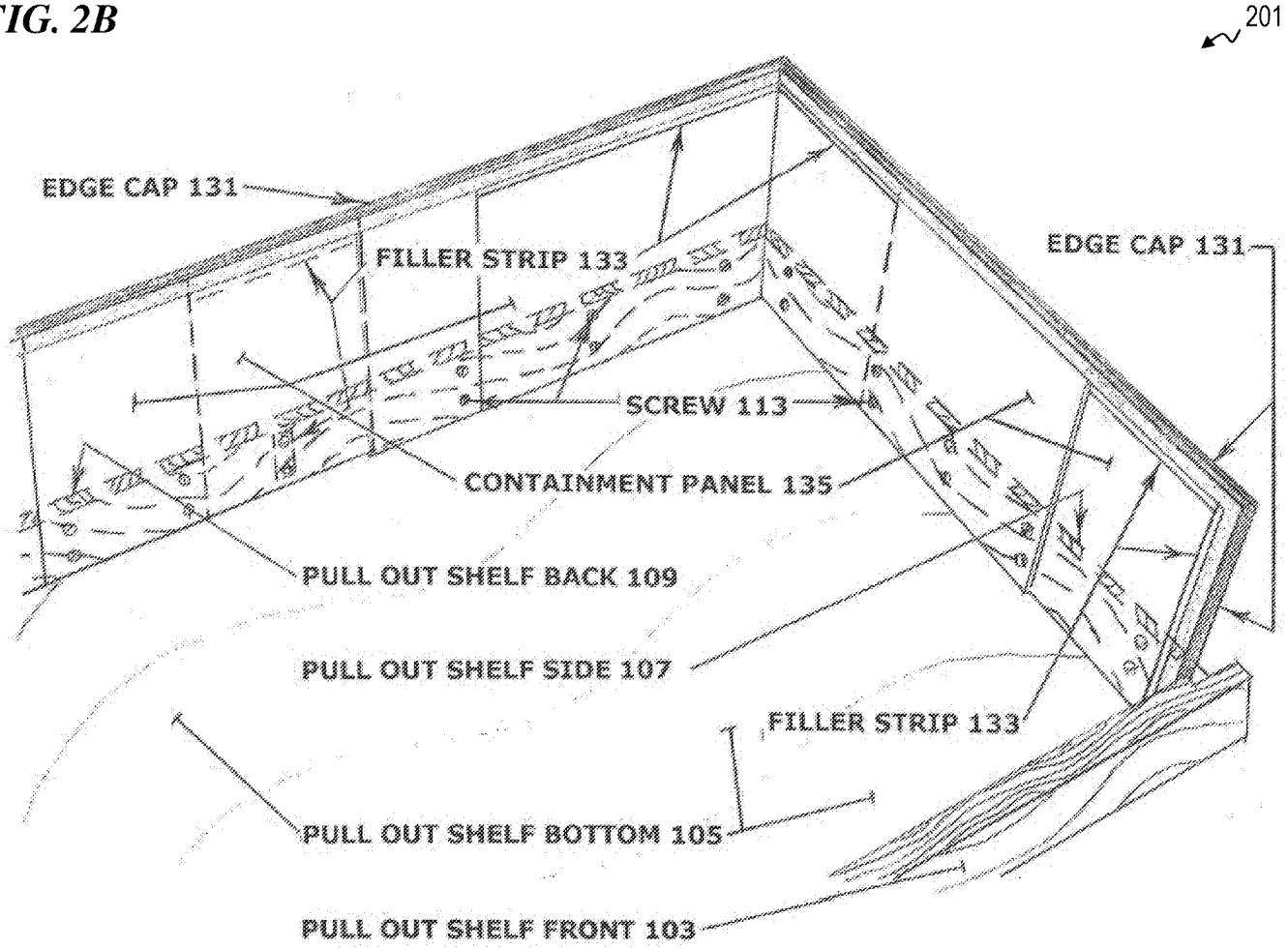
FIG. 2B is an enlargement oblique view of the top right rear corner of containment system 201, as viewed along line 2B of FIG. 2A.

FIG. 2B is an enlargement oblique view of the top right rear corner of the containment shelf and containment system 201, as viewed along line 2B of FIG. 2A.

1. Existing sliding shelf, elements 103 front, 105 bottom, 107 side, and 109 back.
2. Element 135—is a rigid material, approximately ⅛ inch in thickness that may be opaque or transparent. This material is attached to the shelf sides and back, every four to six inches, with screws, and holds the material in place. Elongated screw hole channels allow for panel sliding movement, to accommodate shelf varying widths and lengths.
3. Element 113—self tapping, #8, ½ inch lath screws, attach containment panels 135 to sides and back of sliding shelf.
4. Element 131—edge cap is a rigid plasticized material forming a U channel that has an approximate inside dimension of ¼ inch in width by ½ inch legs. This cap clips together the containment panels 135 and filler strips 133 to reinforce the containment panel 135 edges, while at the same time, eliminating sharp edges. Material can accommodate cutting to various lengths with a razor knife or similar.
5. Element 133—filler strip is an approximate ¾ inch wide strip of containment panel 135 material, used under the edge cap 131, at places where overlapping panels do not occur. This strip provides a second thickness to accommodate the snap-on edge cap 131. The filler strip 133 has an etched groove every ½ inch of its length, to accommodate selecting the approximate length by utilizing snap breaking joints. The filler strip 133 is held in place with a mastic type material of rubberized or plastic material. Filler strip 133 material is also used in 2.0 inch lengths to provide double wall thickness at screw locations, where only a single inside (closest to the center of the shelf) containment panel 135 exists.

Figure 2C:
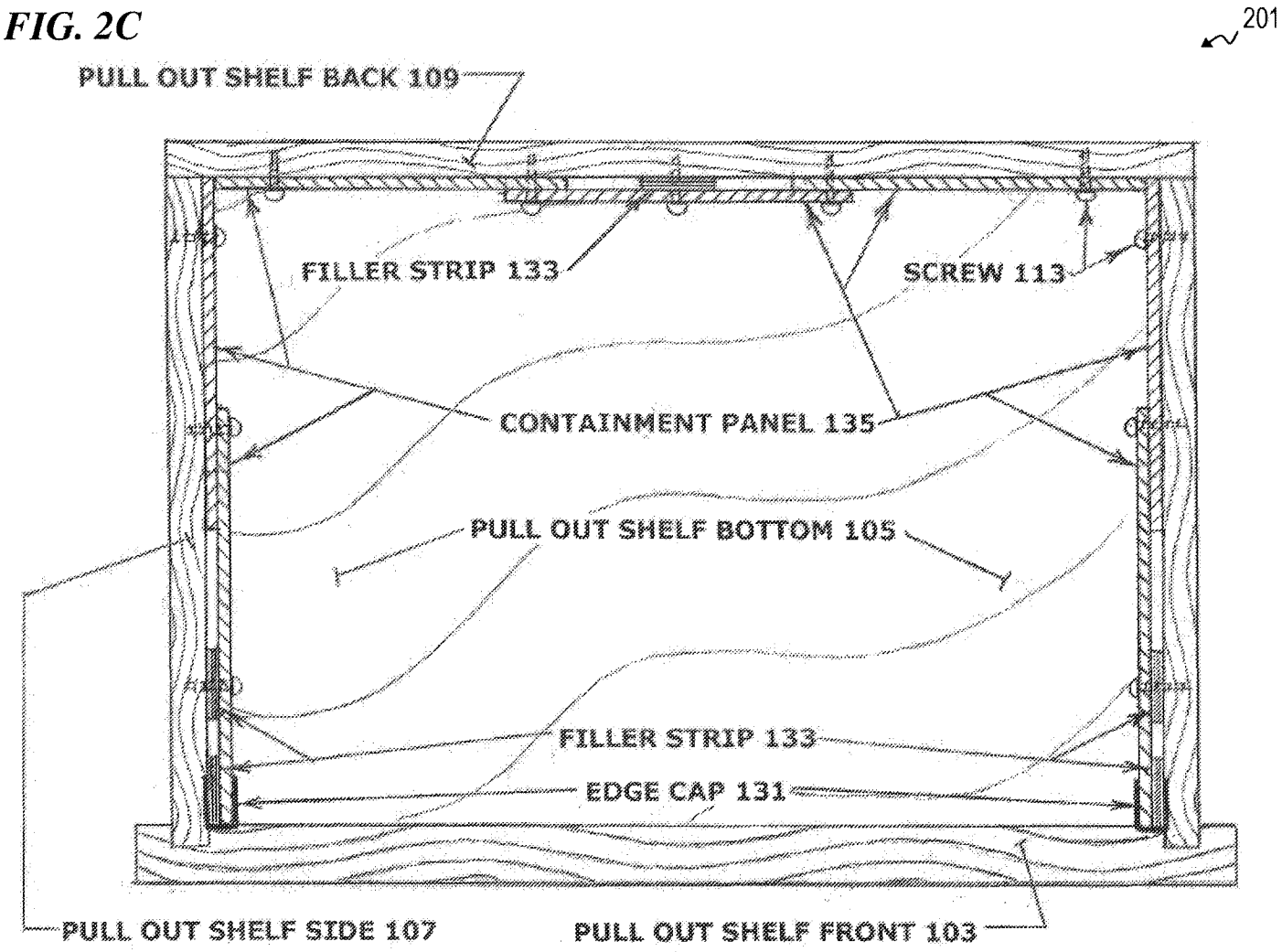
FIG. 2C is a top cross-section view of containment system 201, as viewed along line 2C of FIG. 2A.

FIG. 2C is a top cross-section view of containment system 201, as viewed along line 2C of FIG. 2A.

1. Existing sliding shelf, elements 103 front, 105 bottom, 107 side, and 109 back.
2. Element 135—is a rigid material, approximately ⅛ inch in thickness that may be opaque or transparent. This material is attached to the shelf sides and back, every four to six inches, with screws, and holds the material in place. Elongated screw hole channels allow for panel sliding movement, to accommodate shelf varying widths and lengths.
3. Element 113—self tapping, #8, ½ inch lath screws, attach containment panels 135 to sides and back of sliding shelf.
4. Element 133—filler strip is an approximate ¾ inch wide strip of containment panel 135 material, used at places where overlapping panels do not occur. The filler strip 133 has an etched groove every ½ inch of its length, to accommodate selecting the approximate length by utilizing snap breaking joints. Filler strip 133 material is used in 2.0 inch lengths to provide double wall thickness at screw locations, where only a single inside (closest to the center of the shelf) containment panel 135 exists.

Figure 2D:
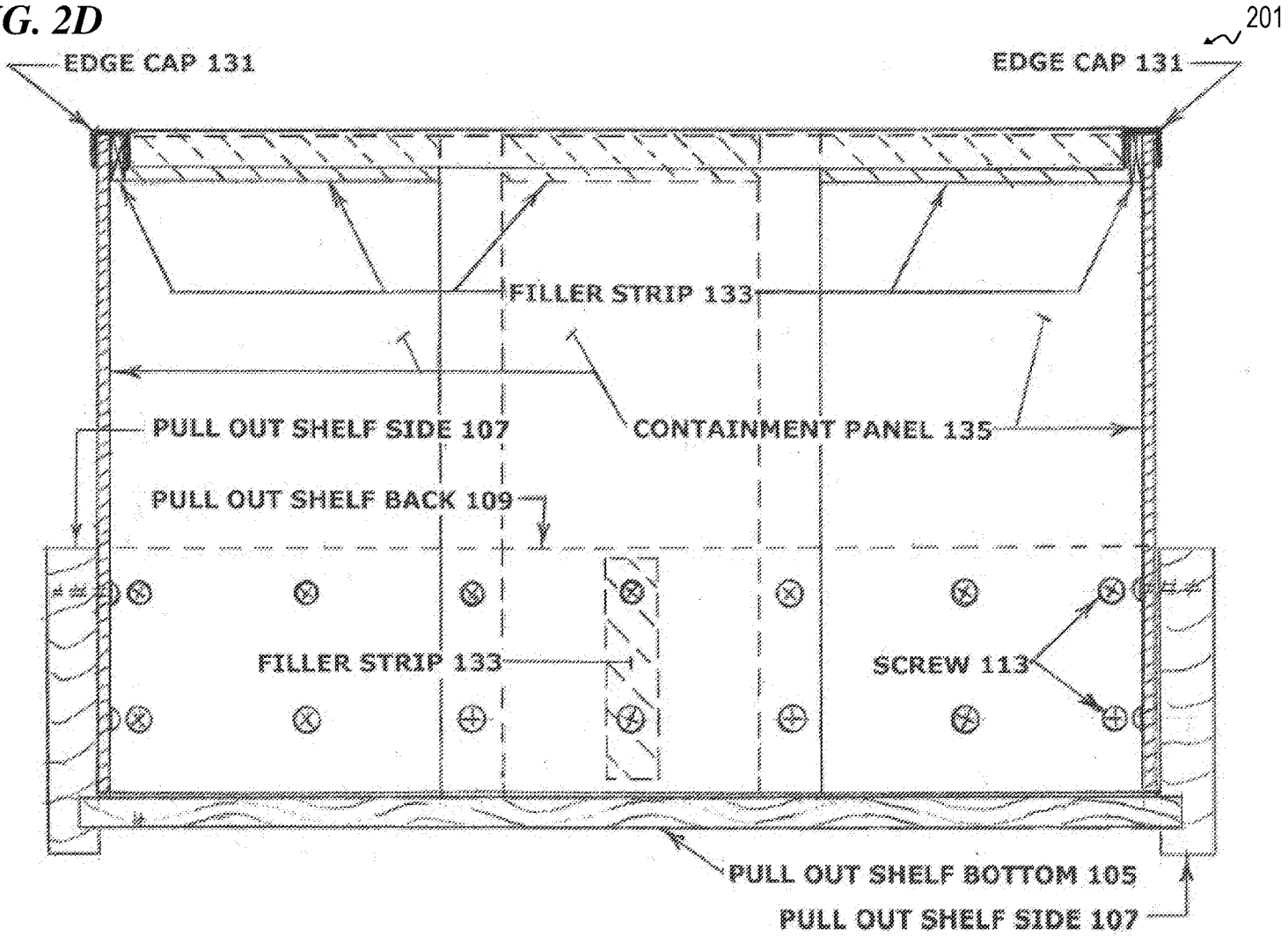
FIG. 2D is a front cross-section view of containment system 201, as viewed along line 2D of FIG. 2A.

FIG. 2D is a front cross-section view of containment system 201, as viewed along line 2D of FIG. 2A.

1. Existing sliding shelf, elements 103 front, 105 bottom, 107 side, and 109 back.
2. Element 135—is rigid material, approximately ⅛ inch in thickness that may be opaque or transparent. This material is attached to the shelf sides and back, every four to six inches, with screws, and holds the material in place. Elongated screw hole channels allow for panel sliding movement, to accommodate shelf varying widths and lengths.
3. Element 113—self tapping, #8, ½ inch lath screws, attach containment panels 135 to sides and back of sliding shelf.
4. Element 131—edge cap is a rigid plasticized material forming a U channel that has an approximate inside dimension of ¼ inch in width by ½ inch legs. This cap clips together the containment panels 135 and filler strips 133 to reinforce the containment panel 135 edges, while at the same time, eliminating sharp edges. Material can accommodate cutting to various lengths with a razor knife or similar.
5. Element 133—filler strip is an approximate ¾ inch wide strip of containment panel 135 material, used under the edge cap 131, at places where overlapping panels do not occur. This strip provides a second thickness to accommodate the snap-on edge cap 131. The filler strip 133 has an etched groove every ½ inch of its length, to accommodate selecting the approximate length by utilizing snap breaking joints. The filler strip 133 is held in place with a mastic type material of rubberized or plastic material. Filler strip 133 material is also used in 2.0 inch lengths to provide double wall thickness at screw locations, where only a single inside (closest to the center of the shelf) containment panel 135 exists.

Figure 2E:
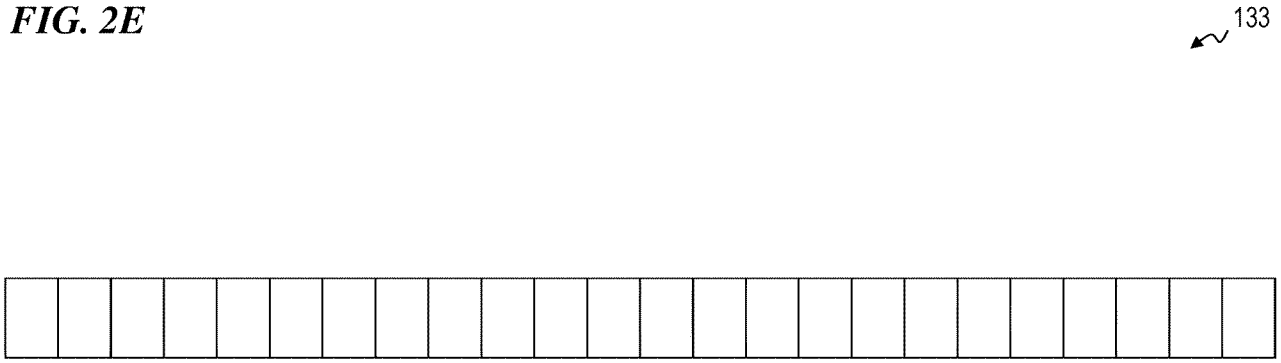
FIG. 2E is a schematic diagram of a filler strip 133, according to some embodiments of the present invention.

FIG. 2E is a schematic diagram of a filler strip 133, according to some embodiments of the present invention. In some embodiments, filler strip 133 comes in ¾×12 inch pieces with scoring every ½ inch to accommodate selecting the approximate length by utilizing snap breaking joints.

General

Sliding shelves are typically manufactured in random sizes to fit in existing cabinetry space shelf width and length measurements. Typically, the side and back heights of these sliding shelves is 2¼ inches—plus or minus. Custom manufacturers can offer increased wall heights during the initial manufacturing process. This product is produced to retro-fit existing sliding shelves that have not been manufactured with extended walls. Typical wall heights contribute to materials tipping and falling off the shelves. This invention is to solve these tipping and falling item problems. Back to dimensions—the third dimension is to measure the height of the cabinetry space to determine the height and type of products that can be placed on these shelves. If the major problem is to solve the tipping and falling condition, then the first embodiment corresponding to Provisional Application 61/908,188—the telescoping rail system solves the problem. If the shelf is to contain horizontally stacked items, and the sliding of these items causes problems—then the second embodiment corresponding to Provisional Application 61/965,331—the containment panel system works better. This application also solves the item tipping and falling problem. Both product applications have a standard height of 8 inches from shelf bottom to top of containment. Higher containment levels can be produced for both products, to bring the rail system up to 11 inches and the panel system up to 12 inches.

Materials for the first embodiment corresponding to Provisional Application 61/908,188—telescoping rail system 101.

a. telescoping rail 115—stainless steel, steel, other metals, fiberglass, rigid plastic and other high tensile materials.
b. rail standard 111—stainless steel, coated steel, other metals, rigid plastic and other high tensile materials.
c. rail end cap 117—stretchable vinyl material with ½ inch inside length and diameter to fit over the ends of the rail.
d. screws 113—zinc coated, 8-gauge, ½ inch length phil mod truss, lath screws.

Materials for the second embodiment corresponding to Provisional Application 61/965,331—containment panel system 201.

a. containment panel 135—0.125 inch thick polycarbonate, 0.125 inch thick acrylic sheet, materials in clear or colored, 8 inch high×12 inch long and 8 inch high×10 inch long typical panels, 12 inch high panels available. All panels are predrilled, and elongated screw hole channels allow for panel sliding movement, to accommodate shelf varying widths and lengths.
b. edge cap 131—c-line Slide 'N Grip Plastic Binding Bars, 11×¼ inches, cut and shaped for vertical and horizontal ells sections.
c. filler strip 133—same material as the containment panel, ¾×12 inch pieces with scoring every ½ inch to allow for break-off lengths. Filler strips at screw location, for maintaining double thickness, are ¾×2 inch dimensions with predrilled screw holes.
d. screws 113—zinc coated, 8-gauge, ½ inch length phil mod truss, lath screws.

Assembly for the first embodiment corresponding to Provisional Application 61/908,188—telescoping rail system 101.

a. measure the inside of the existing sliding shelf. Shelf rail standards 111, to be installed four to six inches center to center. Shorter length and width shelves will have sides and or back lengths that may have three rail standards 111 as close as four inches center to center. Using a pencil, mark rail standard 111 locations, beginning 2¼ inches from each inside corner, to the center of the first rail standard. Divide the remaining distance by 6, and increase to the next whole number. Divide the remaining length by this whole number, to get the spacing for the rail segment. Example for a 30 inch back width shelf—30 minus 4½ (2¼ inches from each corner), equals 25½ inches, divided by 6 is 4¼. Increase to next whole number is 5. Twenty-five and one half inches divided by 5 is a 5.1 inch spacing for this back section. Measure the shelf sides and repeat the same process to obtain spacings. Mark all spacings for rail standards 111 on the shelf bottom, immediately adjacent to the shelf sides and back sections.

b. Install rail standards 111 at all spacing marks. Hold a rail standard 111 in place, lining up the space marking with the center of the rail standard 111, and mark the bottom drill hole. Drill at the bottom hole and install the rail standard (with the rail cradle protrusion to the outside of the shelf) with a screw. Snug up the screw to hold the rail standard 111 in place. Plumb the rail standard 111 to vertical using any 90 degree angle item (like a deck of cards, credit card, note pad, small square, etc.). Mark, drill, and install screw in upper rail standard hole. Check for vertical 90 degrees, and tighten both screws. Complete this process for the remaining rail standard 111 installations.

c. Lay out rails next to all three shelf walls. For side sections, partially insert a smaller diameter rail into a large one. Install rail end caps on each end (smaller end cap onto smaller rail, and larger cap onto larger rail end). Lay the side sections into the rail cradles 119, of the shelf standards 111, with the larger diameter rail toward the front of the shelf. Assemble the shelf back wall rails (three rail sections will have a small diameter rail on each end). Two rail sections will be the same as the side wall sections. Install rail end caps 117 as necessary, and lay the back rails into the back rail standard 111 rail cradles 119 (two section rails can have the small diameter at either end of the back section).

d. Extend the telescoping rails to be flush with the back side of the pull out shelf front. Extend corner telescoping rails to meet at the corners. Pencil-mark each rail at the center of the rail cradle 119.

e. Remove one side rail assembly. Two thicknesses of cradle tape are supplied. Use the thin tape and wrap one revolution over each pencil marking on the large diameter rails. Do the same for the small diameter rails—using the thick tape. Reinstall the side rail assembly, by pressing it down to the bottom of each receiving cradle. Repeat the same process for the other side and back of the shelf.

Assembly for the second embodiment corresponding to Provisional Application 61/965,331 containment panel system.

a. measure the inside of the existing sliding shelf. Twelve inch deep shelves require only one side 8 inch×12 inch containment panel 135. Twelve and a half to 22½ inch depth requires two containment panels 135. Twelve inch wide shelves require only one 8 inch×12 inch containment panel. Twelve and a half to 20.0 inch require 2 containment panels 135 (1-8×12 and 1-8×10 inch). Twenty to 22 inch widths require-2 containment panels 135 (2-8×12 inch). Twenty-two to 30 inch widths require 3 containment panels 135 (2-8×12 and 1-8×10 inch).

b. Measure the inside depth of sliding drawer. If the side dimension is 14½ inches or more, install 8×12 side panel at the right rear corner, using the 8 inch side as the panel height. Drill and install the upper screw hole 2¼ inches from the corner. Hold up the second panel (panel closest to the middle of the slide out shelf), against and touching the back of the pull out shelf front 103. Pencil mark proposed screw holes, in the double thickness portion, 2 inches from the overlap, and evenly along the side panel every 4 to 6 inches. Attach glue side of 2 inch long filler strips 133 to the outside (closest to the pull out shelf side 107) of the panel at screw locations where the inside panel is single thickness. Drill and install one screw at a location close to the midpoint of where the panels overlap. This will hold both panels in place while you drill and install the remaining screws at marked points, using the predrilled panel holes as a guide. Repeat the same installation on the opposite pull out shelf side 107.

c. For side depths of less than 14½ inches and more than 12½ inches—temporarily install corner side panel using the top screw hole 2 inches from the corner. Hold up the second 8×12 inch panel and pencil mark screw holes and attach filler strips 133, as described in 4.b. (above). Remove screw holding the first panel. Hold up both panels and drill and install a screw at a marked hole near the midpoint of the double thickness area. This will hold both panels in place until all screws are installed. Repeat the same installation on the opposite pull out shelf side 107.

d. For back panel installation where the back dimension is less than 14½ inches and more than 12½ inches—start the right rear corner, hold the first panel against the pull out shelf back 109, with the end touching the installed side panel and repeat the steps contained in 4.c. above.

e. For back panel installation where the dimension is less than 22 inches and more than 14½ inches—start the first 8×12 panel against the pull out shelf back 109 right rear corner. Drill and install the upper screw hole 2¼ inches from the corner. Hold up the second 8×12 panel (panel closest to the middle of the slide out shelf), against and touching the left rear corner. Pencil mark proposed screw holes at the mid point of the double thickness portion, and evenly along the back panel every 4 to 6 inches. Attach glue side of 2 inch long filler strips to the outside (closest to the pull out shelf back 109) of the inside panel at screw locations where the inside panel is single thickness. Drill and install one screw at a location close to the midpoint of the panel. This will hold both panels in place while you drill and install the remaining screws at marked points, using the predrilled panel holes as a guide.

f. For back panel installation where the dimension is less than 30 inches or more than 24 inches—install an 8×12 panel against the pull out shelf back 109 in each corner. Drill and install the upper screw hole 2¼ inches from each corner. Center the third 8×10 panel in the gap between the first two panels. Pencil mark all screw hole locations and install filler strips as necessary in the gap between the first two panels. Attach glue side of 2 inch long filler strips to the outside (closest to the pull out shelf back 109) of the panel. Drill and install one screw at a marked location close to the midpoint of the panel.

This will hold all panels in place while you drill and install the remaining screws at marked points, using the predrilled panel holes as a guide.

g. Before you install the top and front edge cap 131, additional filler strips must be installed to provide a gripping surface for the edge cap 131. All areas along the edge cap 131, must receive filler strips to make the edge a double thickness. Starting on the side panel at the right rear corner of the sliding shelf—this single section will receive a filler strip 133, on the side closest to the sliding shelf center. Hold the break-off strip against the single panel and mark the length with a pencil. If this mark falls in between break-off points, go to the next shortest break-off point on the strip and (using two pliers) break the strip at that location. That will allow the strip to fit into the gap. Install the glue side to the inside of the corner side panel. Moving toward the front of the sliding shelf, repeat the measurement, break off, and glue attachment for the strip on the outside of the second panel. Then repeat the measurement, break-off, and glue attachment for the vertical front strip. Move to the other side and repeat the same procedure. Now move to the back right corner of the shelf, and repeat the measurement, break-off, and glue and attach the strip on the inside of the first panel attached to the back of the shelf. Then repeat the measurement, break-off, and glue attachment for the entire horizontal strip. As you move toward the shelf left back corner, alternate sides (when there are two or three back panels) when applying filler strips 133.

h. When all filler strips are installed, there should be a continuous double thickness of containment panels 135 and filler strips 133, all along the top of the containment panels 135, and from the top of the front two containment panels 135, down to the top of the pull out shelf front.

i. Begin installing edge caps 131. Use the ell edge cap 131 consisting of the vertical and horizontal angle—to be applied to the front two corners of the containment panels. Measure the distance from the top of the front two containment panels 135, down to the top of the pull out shelf front. Using a razor knife, carefully cut the ell edge cap 131, to the measurement. Install edge cap 131, starting at the top of the pull out shelf front. Spread the bottom corner legs of the edge cap, and insert it over the containment panel 135, and filler strip 133, at the bottom of the vertical section. Gently apply pressure on the back of the edge cap 131, as you move up the edge cap. When the edge cap is fully seated on the vertical portion of the panel, gently apply pressure on the back of the edge cap 131, as you move horizontally toward the rear corner of the shelf. When this edge cap is fully seated, install the horizontal ell edge cap 131 on the back corners, using the same procedure. There will be gaps between the ell edge caps 131 on the tops of the panels on the sides and back of the shelf. Measure the gap distance, and (using a razor knife) carefully cut and install a section of straight edge cap 131, to the measurement. Two straight sections of edge cap 131 may be required on the back panels of wide shelves. Apply pressure to all edge cap 131 sections to complete the installation.

What is claimed is:

1. A kit to be retro-fit onto a sliding shelf, wherein the sliding shelf is configured to be extended substantially horizontally, wherein the sliding shelf includes a bottom area and a plurality of walls that form a containment perimeter of the sliding shelf to a first height above the bottom area, wherein each wall of the plurality of walls has an inward-facing surface and an outward-facing surface, wherein each wall of the plurality of walls has a plane that passes vertically through the wall, wherein the kit is configured to increase the first height of the containment perimeter to a second height above the bottom area, and wherein the kit comprises:

a plurality of straight vertical panel filler strips including a first panel filler strip and a second panel filler strip, wherein each respective panel filler strip of the plurality of panel filler strips has an inward-facing surface and an outward-facing surface, wherein each respective panel filler strip has holes for receiving a plurality of fasteners, and wherein each respective panel filler strip is configured to be attached, using the plurality of fasteners, to the inward-facing surface of a respective wall of the plurality of walls such that an entirety of the respective straight panel filler strip extends along a line that parallels the plane of the respective wall; and a plurality of containment members including a first containment member and a second containment member, wherein each respective one of the plurality of containment members includes a first flat piece and a second flat piece that each have a planar shape, wherein the first flat piece partially overlaps and touches the second flat piece, wherein the first flat piece of each respective one of the plurality of containment members is configured to be attached directly to a respective wall of the sliding shelf, and wherein the second flat piece of each respective one of the plurality of containment members is configured to be attached to the respective wall with one of the plurality of panel filler strips located between the second flat piece and the respective wall.

2. The kit of claim 1, wherein the plurality of panel filler strips is made from a polycarbonate, and wherein the plurality of containment members is made from a polycarbonate.

3. The kit of claim 1, further comprising a plurality of edge caps including a first edge cap and a second edge cap, wherein the first edge cap forms a U-channel that is configured to be snapped on over at least a top edge of at least the first containment member.

4. The kit of claim 1, further comprising:

a plurality of edge caps including a first edge cap and a second edge cap, wherein the first edge cap forms a U-channel that is configured to be snapped on over at least a top edge of at least the first containment member; and a plurality of cap filler strips including a first cap filler strip and a second cap filler strip, wherein the first cap filler strip is configured to be placed adjacent to the first containment member to form a combined width that accommodates the U-channel.

5. The kit of claim 1, further comprising:

the plurality of fasteners, wherein the plurality of fasteners are screws configured to attach the second flat piece of each respective containment member to the respective wall through the holes of the respective panel filler strip, and to affix at least the first flat piece to the inner surface of one of the plurality of walls.

6. The kit of claim 1, further comprising:

the plurality of fasteners, wherein the plurality of fasteners includes a first fastener and a second fastener, wherein the first fastener is configured to affix an overlapping portion of the first flat piece and the second flat piece to the inner surface of one of the plurality of walls, and wherein the second fastener is configured to pass through holes in the second flat piece of the respective containment member and through the holes of the first panel filler strip such that the second flat piece of the respective containment member and the first panel filler strip are affixed to one of the plurality of walls.

7. The kit of claim 1, wherein, for each respective one of the plurality of containment members:

the second flat piece is configured to be affixed touching the inner surface of the first panel filler strip, the outward-facing surface of the first panel filler strip is configured to be affixed touching the inward-facing surface of a first one of the plurality of walls, and the first flat piece is configured to be affixed to the inward-facing surface of the first one of the plurality of walls.

8. The kit of claim 1, wherein the inward-facing surface of each respective panel filler strip of the plurality of panel filler strips includes glue to secure the respective panel filler strip to an outward-facing surface of a respective second flat piece.

9. The kit of claim 1, further comprising:

a plurality of edge caps including a first edge cap and a second edge cap, wherein the first edge cap forms a U-channel that is configured to be snapped on over at least a top edge of at least the first containment member; and the plurality of fasteners, wherein the plurality of fasteners are configured to attach each respective panel filler strip to the respective wall through the holes of the respective panel filler strip, and to affix at least the first flat piece to the inner surface of one of the plurality of walls.

10. An apparatus for containing objects on a sliding shelf, wherein the sliding shelf is configured to be extended substantially horizontally, wherein the sliding shelf includes a bottom area and a plurality of walls that form a containment perimeter of the sliding shelf to a first height above the bottom area, wherein each wall of the plurality of walls has an inward-facing surface and an outward-facing surface, and wherein the apparatus comprises:

at least a first panel filler strip, wherein the first panel filler strip has an inward-facing surface and an outward-facing surface; and at least a first containment member, wherein the first containment member includes a first flat piece and a second flat piece that each have a planar shape, wherein the first flat piece partially overlaps and touches the second flat piece, wherein the first flat piece of the first containment member is configured to be attached directly to a respective wall of the sliding shelf, and wherein the second flat piece of the first containment member is configured to be attached to the respective wall with the first panel filler strip located between the second flat piece and the respective wall.

11. The apparatus of claim 10, wherein the first panel filler strip is made from a polycarbonate, and wherein the first containment member is made from a polycarbonate.

12. The apparatus of claim 10, further comprising at least a first edge cap, wherein the first edge cap forms a U-channel that is configured to be snapped on over at least a top edge of the first containment member.

13. The apparatus of claim 10, further comprising:

at least a first edge cap, wherein the first edge cap forms a U-channel that is configured to be snapped on over at least a top edge of the first containment member; and at least a first cap filler strip, wherein the first cap filler strip is configured to be placed adjacent to the first containment member to form a combined width that accommodates the U-channel.

14. The apparatus of claim 13, wherein the first cap filler strip includes a plurality of grooves, each configured as a joint for breaking the first cap filler strip into a plurality of component cap filler strips.

15. The apparatus of claim 10, wherein the first panel filler strip includes a first plurality of holes, wherein the second flat piece of the first containment member includes a second plurality of holes, the apparatus further comprising:

a plurality of fasteners, wherein the plurality of fasteners are screws configured to attach the second flat piece to the respective wall through the first plurality of holes of the first panel filler strip and through the second plurality of holes in the second flat piece, and to affix at least the first flat piece to the inward-facing surface of one of the plurality of walls.

16. The apparatus of claim 10, wherein the first panel filler strip includes a first plurality of holes, wherein the second flat piece of the first containment member includes a second plurality of holes, the apparatus further comprising:

a plurality of fasteners, wherein the plurality of fasteners includes a first fastener and a second fastener, wherein the first fastener is configured to affix an overlapping portion of the first flat piece and the second flat piece to the inner surface of one of the plurality of walls, wherein the second flat piece is configured to be affixed to the inner surface of the first panel filler strip, and wherein the second fastener is configured to pass through the first plurality of holes of the first panel filler strip and through the second plurality of holes in the second flat piece such that the second flat piece and the first panel filler strip are affixed to one of the plurality of walls.

17. The apparatus of claim 10, wherein the second flat piece is configured to be affixed touching the inward-facing surface of the first panel filler strip, wherein the outward-facing surface of the first panel filler strip is configured to be affixed touching the inward-facing surface of a first one of the plurality of walls, and wherein the first flat piece is configured to be affixed to the inward-facing surface of the first one of the plurality of walls.

18. The apparatus of claim 10, wherein the inward-facing surface of the first panel filler strip includes mastic to secure the first panel filler strip to an outward-facing surface of the second flat piece.

19. The apparatus of claim 10, wherein the first panel filler strip includes a first plurality of holes, wherein the second flat piece of the first containment member includes a second plurality of holes, the apparatus further comprising:

at least a first edge cap, wherein the first edge cap forms a U-channel that is configured to be snapped on over at least a top edge of the first containment member; and a plurality of fasteners, wherein the plurality of fasteners are screws configured to attach the second flat piece to the respective wall through the first plurality of holes of the first panel filler strip and through the second plurality of holes in the second flat piece, and to affix at least the first flat piece to the inner surface of one of the plurality of walls.

20. A method for installing a containment system onto a sliding shelf, wherein the sliding shelf is configured to be extended substantially horizontally, wherein the sliding shelf includes a bottom area and a plurality of walls that form a containment perimeter of the sliding shelf to a first height above the bottom area, wherein each wall of the plurality of walls has an inward-facing surface and an outward-facing surface, wherein each wall of the plurality of walls has a plane that passes vertically through the wall, wherein the containment system is configured to increase the first height of the containment perimeter to a second height above the bottom area, wherein the containment system includes:

at least a first panel filler strip, wherein the first panel filler strip has an inward-facing surface and an outward-facing surface, wherein the inward-facing surface of the first panel filler strip includes glue, at least a first containment member, wherein the first containment member includes a first flat piece and a second flat piece that each have a planar shape, wherein the first flat piece partially overlaps and touches the second flat piece, wherein the first flat piece and the second flat piece each have an inward-facing surface and an outward-facing surface, the method comprising:

providing the containment system;

measuring the sliding shelf to determine a spacing for the first containment member;

marking the spacing for the first containment member on the sliding shelf;

attaching, using the glue, the inward-facing surface of the first panel filler strip to the outward-facing surface of the second flat piece at a support location where the second flat piece does not overlap the first flat piece;

removably affixing, using a first plurality of fasteners, the first flat piece to the second flat piece at an overlap location where the first flat piece overlaps the second flat piece;

removably affixing, using the first plurality of fasteners, the overlap location of the first and second flat pieces to the inward-facing surface of a respective wall of the plurality of walls; and removably affixing, using a second plurality of fasteners, the support location of the outward-facing surface of the second flat piece to the respective wall.

* * * * *